US011834910B2

(12) United States Patent
Duran et al.

(10) Patent No.: US 11,834,910 B2
(45) Date of Patent: Dec. 5, 2023

(54) FLOAT APPARATUS

(71) Applicant: Eddy Pump Corporation, El Cajon, CA (US)

(72) Inventors: Hector Duran, El Cajon, CA (US); Daniel Wahlgren, Escondido, CA (US); Roberto Gonzalez, El Cajon, CA (US)

(73) Assignee: EDDY PUMP CORPORATION, El Cajon, CA (US)

( * ) Notice: Subject to any disclaimer, the term of this patent is extended or adjusted under 35 U.S.C. 154(b) by 0 days.

(21) Appl. No.: 17/668,099

(22) Filed: Feb. 9, 2022

(65) Prior Publication Data

US 2023/0250698 A1 Aug. 10, 2023

(51) Int. Cl.
*E21B 17/01* (2006.01)

(52) U.S. Cl.
CPC ..... *E21B 17/015* (2013.01); *E21B 17/012* (2013.01)

(58) Field of Classification Search
CPC ..... E21B 17/015; E21B 17/012
USPC ..... 166/350
See application file for complete search history.

(56) References Cited

U.S. PATENT DOCUMENTS 6,004,074 A 12/1999 Shanks, II
6,155,748 A * 12/2000 Allen ..... E21B 17/012 166/359
6,241,425 B1 6/2001 Kazim
6,402,431 B1 * 6/2002 Nish ..... E21B 17/012 405/224.3
6,435,775 B1 * 8/2002 Nish ..... F16L 1/24 405/195.1
6,488,447 B1 * 12/2002 Nish ..... E21B 17/012 405/195.1
6,503,112 B1 * 1/2003 Chadwick ..... B63B 3/08 441/3
7,628,665 B1 * 12/2009 Cook ..... E21B 17/012 405/195.1
9,316,064 B2 4/2016 Patriciu
2003/0089075 A1 * 5/2003 Oram ..... E21B 17/01 52/750
2003/0150618 A1 * 8/2003 Nish ..... E21B 17/012 405/224.2
2004/0126192 A1 * 7/2004 Nish ..... E21B 17/012 405/224.2
2008/0025800 A1 * 1/2008 Watkins ..... E21B 17/01 405/216
2015/0068759 A1 * 3/2015 Harbison ..... E21B 17/012 166/350
2018/0252334 A1 * 9/2018 Harrop ..... F16B 2/065
2019/0264833 A1 * 8/2019 Harbison ..... F16L 1/123

* cited by examiner

*Primary Examiner* — Matthew R Buck
*Assistant Examiner* — Patrick F Lambe
(74) *Attorney, Agent, or Firm* — GLOBAL IP COUNSELORS, LLP

(57) ABSTRACT

A float apparatus includes a buoyant device that has an outer surface with a first end portion, a second end portion and an elongated portion. The elongated portion extends from the first end portion to the second end portion. The buoyant device is shaped and configured to attach to a conduit. The elongated portion of the outer surface has a concaved section that extends from the first end portion to the second end, portion. The concaved section has a shape that complements an cuter radius of the conduit with the buoyant device attached to the conduit.

19 Claims, 13 Drawing Sheets

FLOAT APPARATUS

BACKGROUND

Technical Field

The present disclosure generally relates to a slurry transporting riser assembly. More specifically, the present disclosure relates to buoyant device of slurry transporting riser assembly where the buoyant device as an outer surface portion that complements an outer radius of a slurry pipe with the buoyant device attached to the slurry pipe.

Background Information

Slurry pipes (also known as risers) are typically used in a large body of liquid and extend from a deep portion of the body of liquid to above the surface of the body of liquid. In some applications, the pipe or riser requires added buoyancy to keep an upper end of the slurry pipe near or above the surface of the body of liquid.

SUMMARY

One object of the present disclosure is to provide a slurry pipe with a buoyant device or plurality of buoyant devices that are simple to install to the slurry pipe and include a surface section that receives and mates with a portion of the outer surface of the slurry pipe.

In view of the state of the known technology, one aspect of the present disclosure is to provide a slurry transporting riser assembly with a buoyant device that has an outer surface with a first end portion, a second end portion and an elongated portion. The elongated portion extends from the first end portion to the second end portion. The buoyant device is shaped and configured to attach to a slurry pipe. The elongated portion of the outer surface has a concaved section that extends from the first end portion to the second end portion. The concaved section has a shape that complements an outer radius of the slurry pipe with the buoyant device attached to the slurry pipe.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
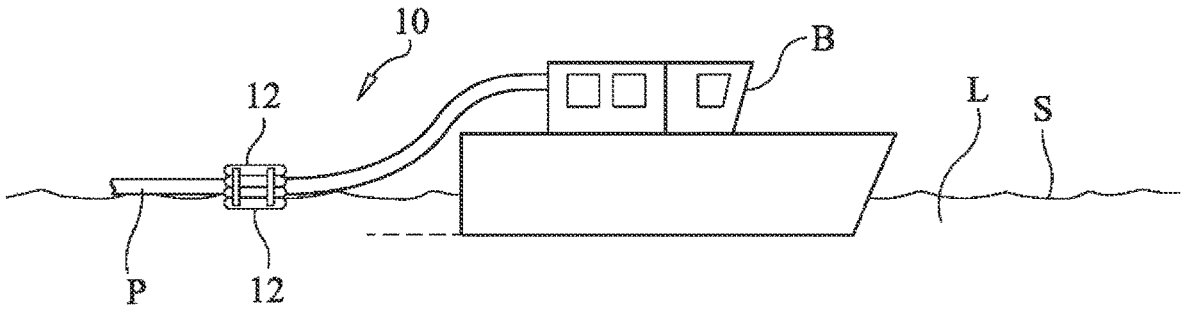
FIG. 1 is a schematic diagram of slurry transporting riser assembly used with a large boat to bring slurry from a body of liquid to the surface of the liquid is a slurry pipe that includes a plurality of buoyant devices attached to and surrounding the slurry pipe in accordance with a first embodiment.
Figure 2:
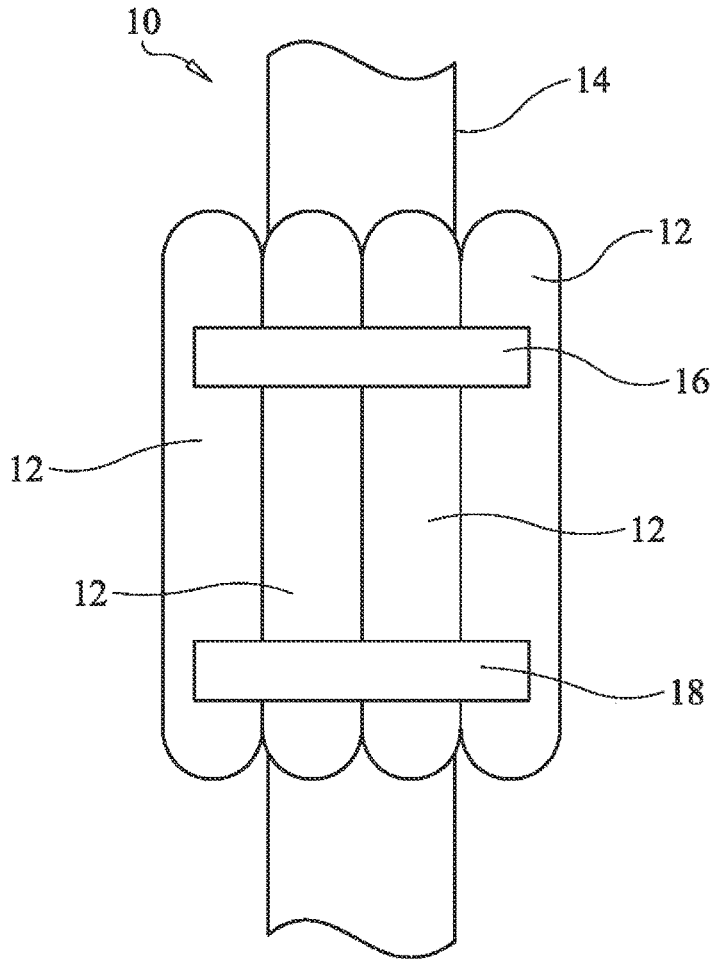
FIG. 2 is an enlarged portion of FIG. 1 showing the slurry pipe with the plurality of buoyant devices strapped to the slurry pipe in accordance with the first embodiment.

Referring initially to FIGS. 1 and 2, a slurry transporting riser assembly 10 having at least one buoyant device 12 configured to attach to a slurry pipe P (also referred to as a riser) is illustrated in accordance with a first embodiment.

Figure 3:
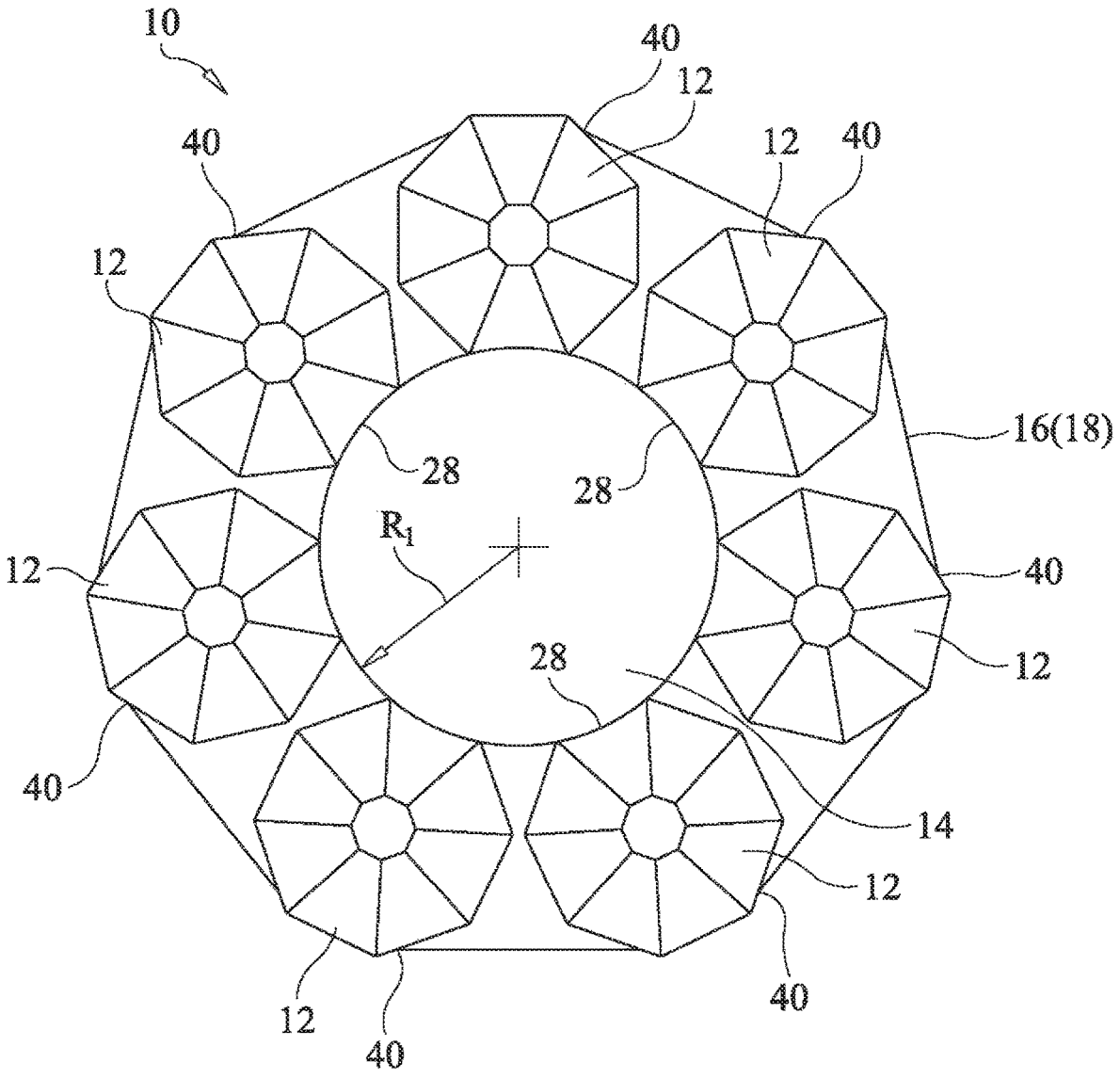
FIG. 3 is a top view of the slurry pipe and a plurality of buoyant devices attached thereto via a pair of straps in accordance with the first embodiment.

The slurry transporting riser assembly 10 can be used in any of a variety of applications where a slurry is to be pumped from beneath the surface S of a liquid L or slurry mixture to a location above the surface S of the liquid L or slurry mixture. In one example depicted in FIG. 1, the slurry transporting riser assembly 10 is used with a floating vessel or boat B that is on the surface of a body of water with the liquid L such as a river or canal where, for example, a dredging operation is being conducted. Slurry from the bottom of the river or canal is pumped through a pipe P to the boat B and then further to a shoreline (not shown) along the river or canal. An outer surface of the pipe P (also referred to as a slurry pipe and a riser) has at least a portion thereof having a cylindrically shape. The outer surface of the pipe also defines a pipe radius $R_1$, as shown in FIG. 3.

Figure 4:
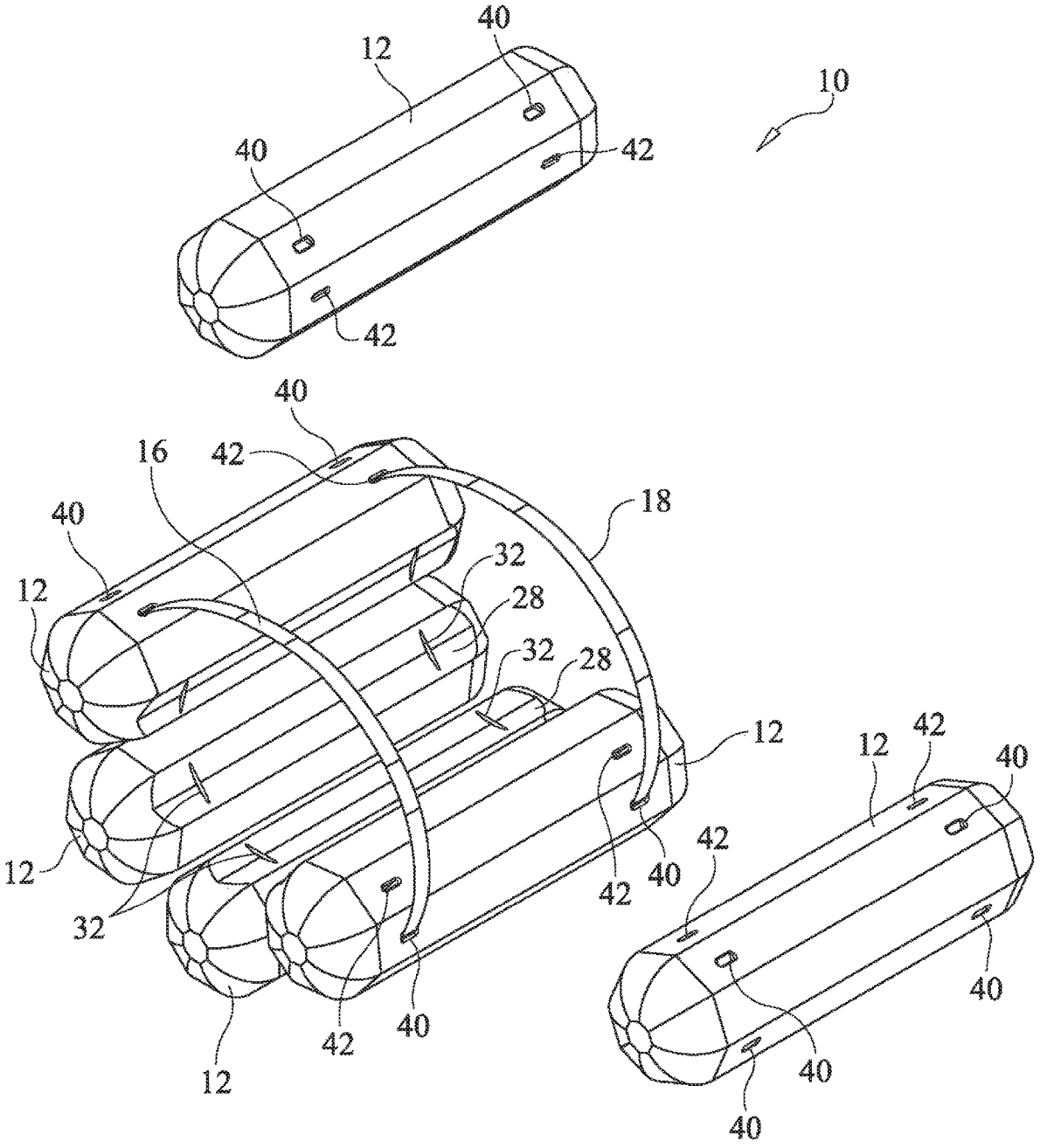
FIG. 4 is an exploded view of the plurality of buoyant devices and the pair of straps with the pipe removed in accordance with the first embodiment

An upper portion of the pipe P is preferably kept near the surface S of the L by one or more of the buoyant devices 12, as shown in FIG. 1. As shown in FIGS. 2-4, a plurality of the buoyant devices 12 are attached to the pipe P via straps 16 and 18 in a manner described further below following a description of one of the buoyant devices 12.

In the first embodiment shown in FIGS. 5-12 and described below, one or a plurality of buoyant devices 12 can be used with a single pipe P. Each of the plurality of the buoyant devices 12 a identical to one another. Therefore, description of one of the buoyant devices 12 applies to all of the plurality of the buoyant devices 12 depicted in FIGS. 1-4.

Figure 8:
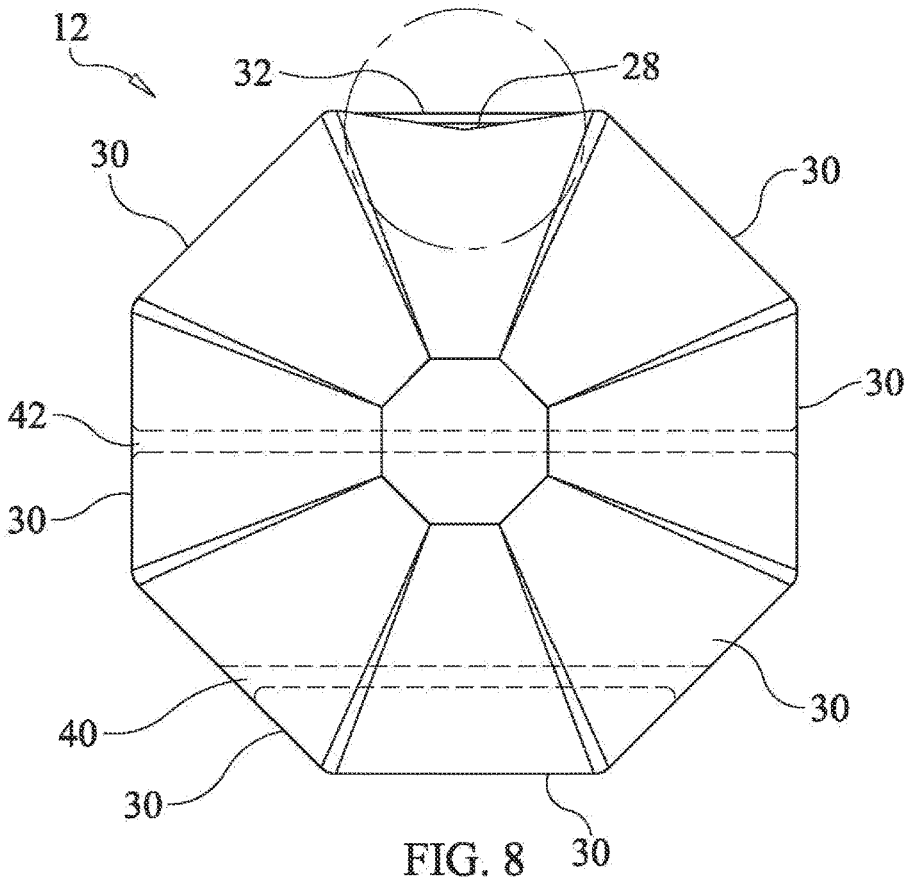
FIG. 8 is an end view of the buoyant device depicted in FIG. 5 showing the first end, the concaved area and one of projections within the concaved area in accordance with the first embodiment.
Figure 9:
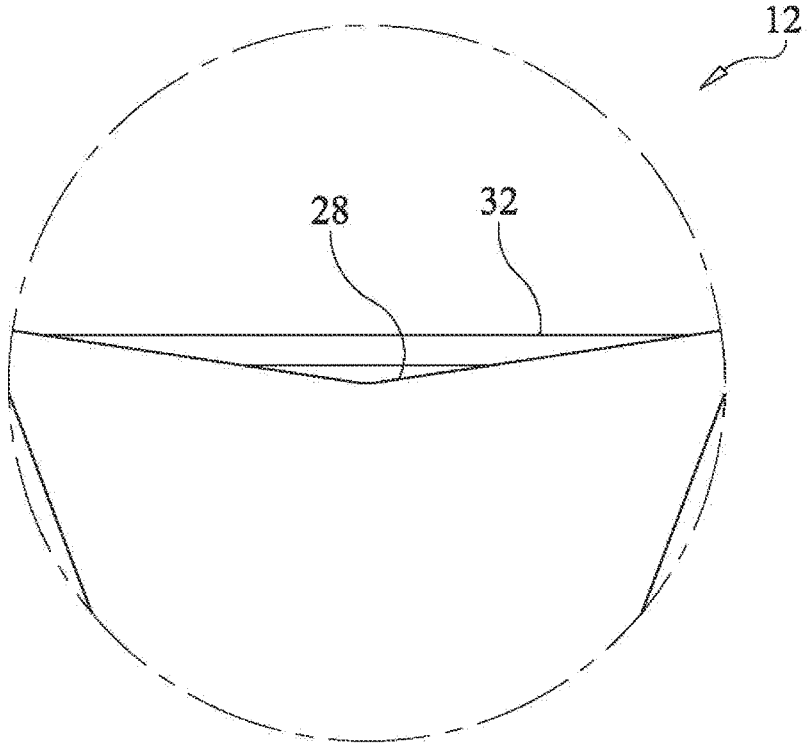
FIG. 9 is an enlarged end view of the buoyant device depicted in FIG. 8 showing only the concaved area and one of projections within the concaved area in accordance with the first embodiment.
Figure 10:
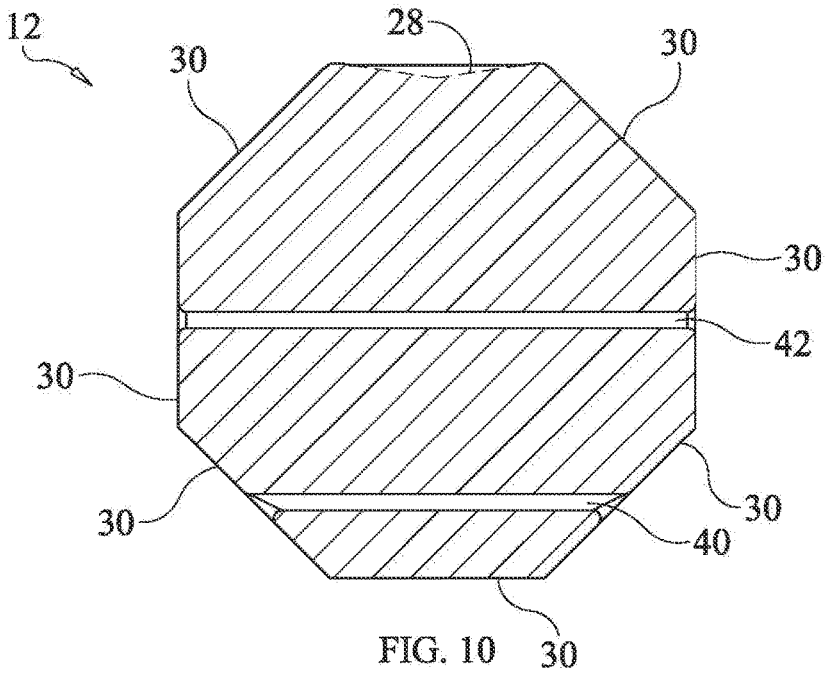
FIG. 10 is a cross-sectional view of the buoyant device taken along the line 10-10 in FIG. 7 showing the first and second strap receiving tunnels that extend through the buoyant device in accordance with the first embodiment.

As shown in FIGS. 5-12, the buoyant device 12 has an outer surface 20 with a first end portion 22, a second end portion 24 and an elongated portion 26. The elongated portion 26 extends from the first end portion 22 to the second end portion 24. The elongated portion 26 has an overall shape that resembles a cylinder when viewed from a distance. The cylinder shape is interrupted by a concaved section 28. In the first embodiment, the resemblance to a cylinder of the elongated portion 26 is achieved with the outer surface 20 having an octagonal shape with eight sections including seven flat sections 30, as shown in FIGS. 8 and 10. The last section of the eight sections that define the outer surface 20 in the first embodiment is the concaved section 28.

The first end portion 22 and the second end portion 24 of the outer surface 20 of the buoyant device 12 has an overall semi-spherical shape as viewed from a distance. However, like the elongated portion 26, each of the first and second end portions 22 and 24 include eight separate sections that curve d to define the overall semi-spherical shape.

The concaved section 28 defines a shape that complements the outer radius $R_1$ (the pipe radius) of the pipe P. Consequently, with the concaved section 28 being strapped in place against the outer surface of the pipe P, the buoyant device 12 can attach to the pipe P without rotating with respect to the pipe P.

Figure 5:
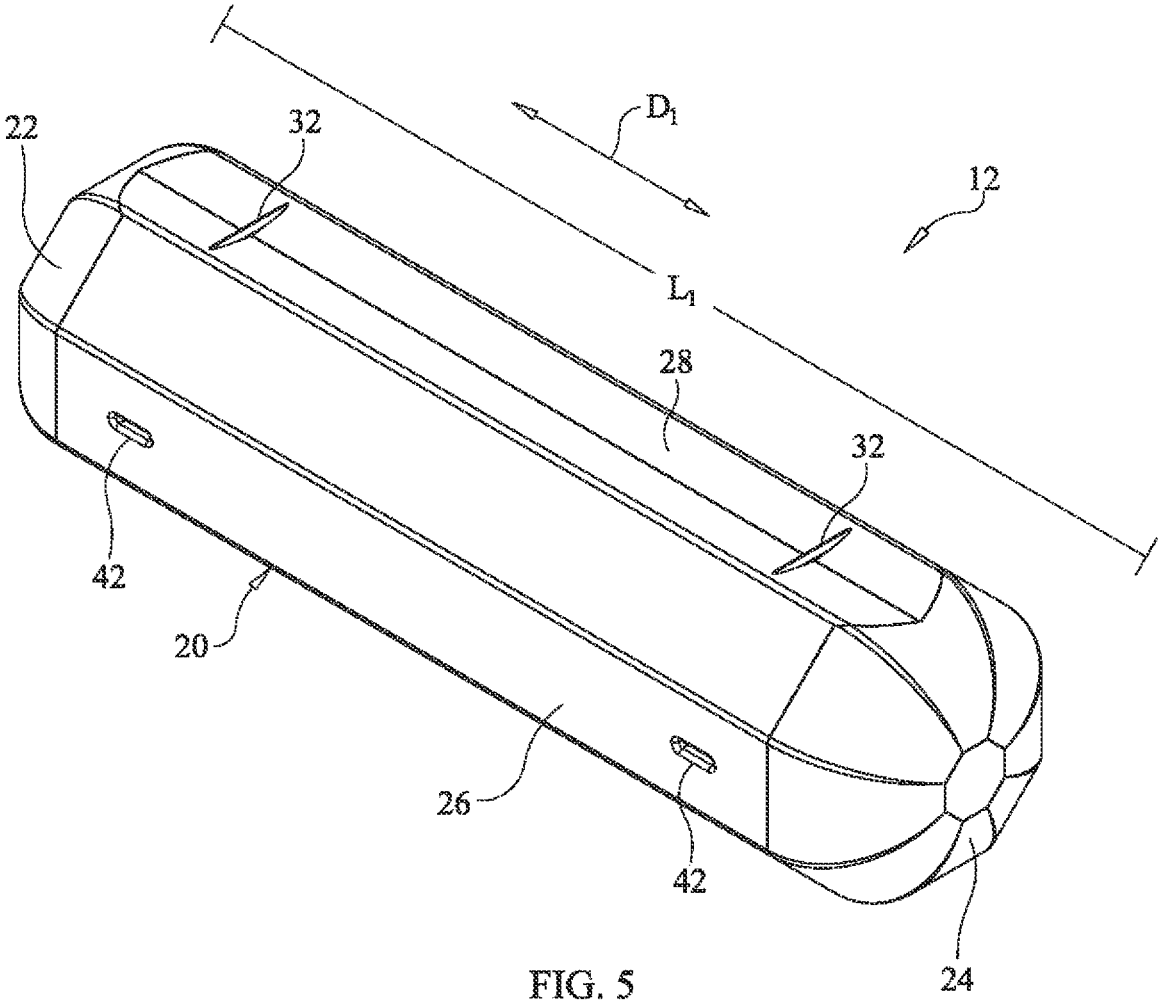
FIG. 5 is a perspective view of one of the buoyant devices showing an outer surface with a first end, a second end and an elongated portion that includes a concaved area and a pair of projections within the concaved area in accordance with the first embodiment.
Figure 6:
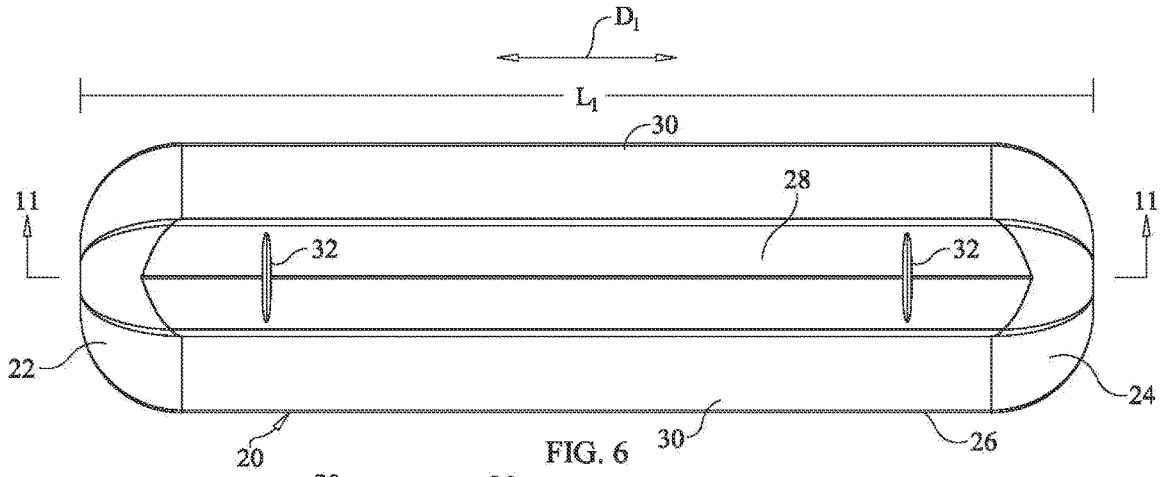
FIG. 6 is a first side view of the buoyant device depicted in FIG. 5 showing the outer surface, the first end, the second end, the elongated portion, the concaved area and the pair of projections within the concaved area in accordance with the first embodiment.
Figure 7:
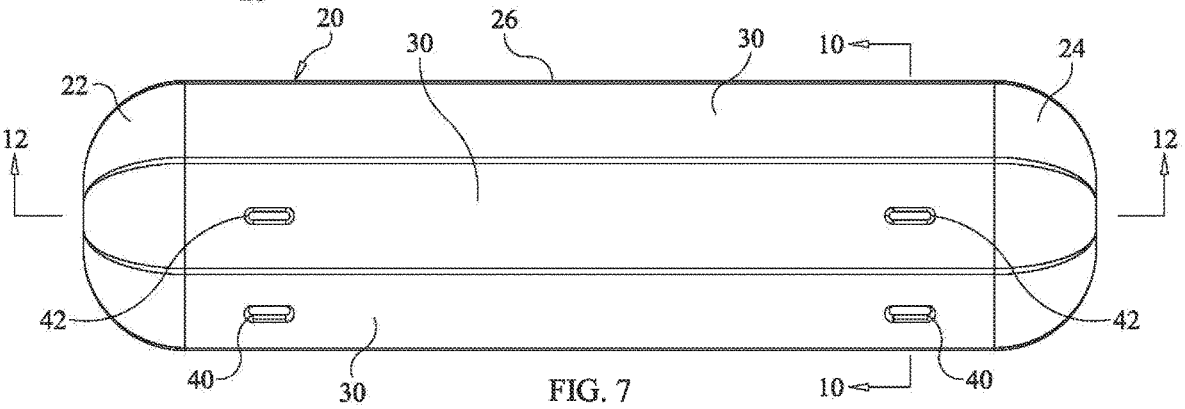
FIG. 7 is a second side view of the buoyant device depicted in FIG. 5 showing the outer surface, the first end, the second end, and first and second strap receiving tunnels in accordance with the first embodiment.

The buoyant device 1 has an overall length $L_1$ measured in a lengthwise direction $D_1$ of the buoyant device 12, as shown in FIGS. 5 and 6. The concaved section 28 includes at least one protrusion 32 and preferably two protrusions 32 that are dimensioned and shaped to contact the pipe P preventing longitudinal movement therebetween with the buoyant device 12 strapped to the pipe P. Both of the protrusions 32 extend in a directions perpendicular to the lengthwise direction $D_1$ of the buoyant device 12, as shown in FIG. 6.

Figure 11:
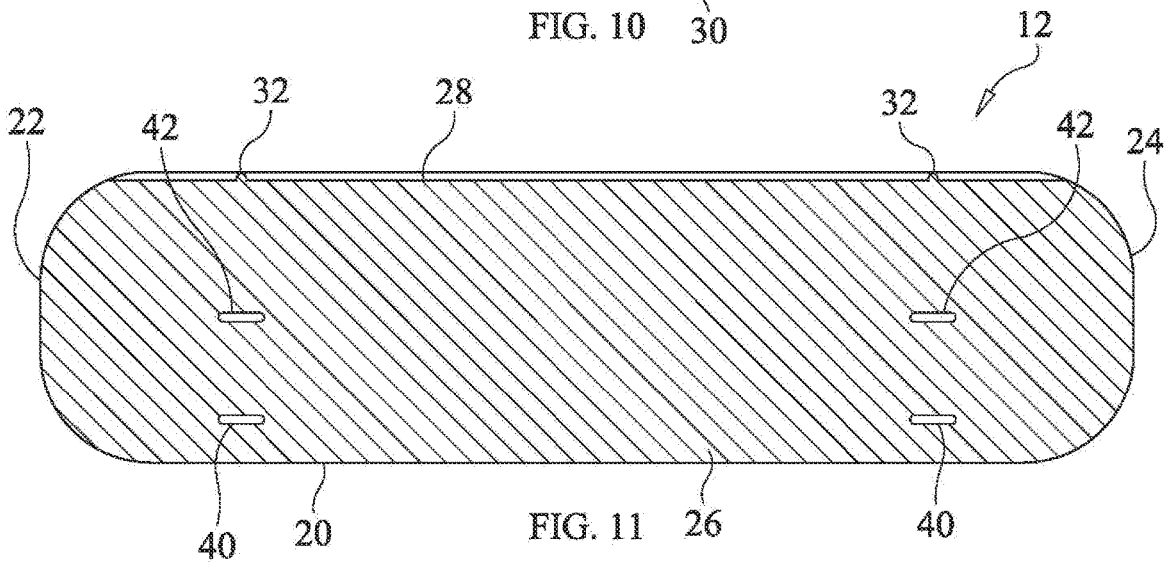
FIG. 11 is a cross-sectional view of the buoyant device taken along the line 11-11 in FIG. 6 showing the first and second strap receiving tunnels, the concaved area and the pair of projections within the concaved area in accordance with the first embodiment.
Figure 12:
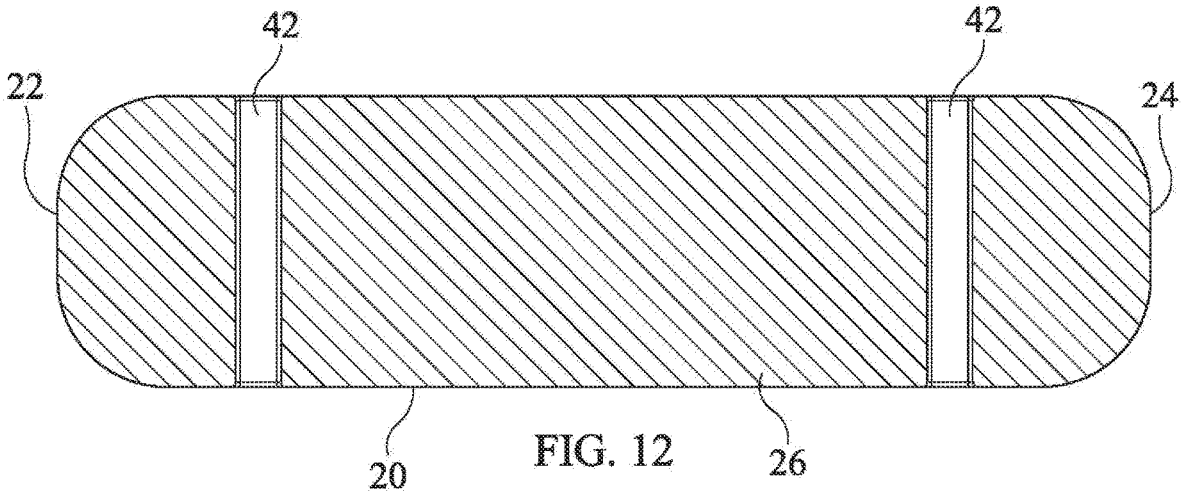
FIG. 12 is a cross-sectional view of the buoyant device taken along the line 12-12 in FIG. 7 showing the second strap receiving tunnels that extend through the buoyant device in accordance with the first embodiment.
Figure 13:
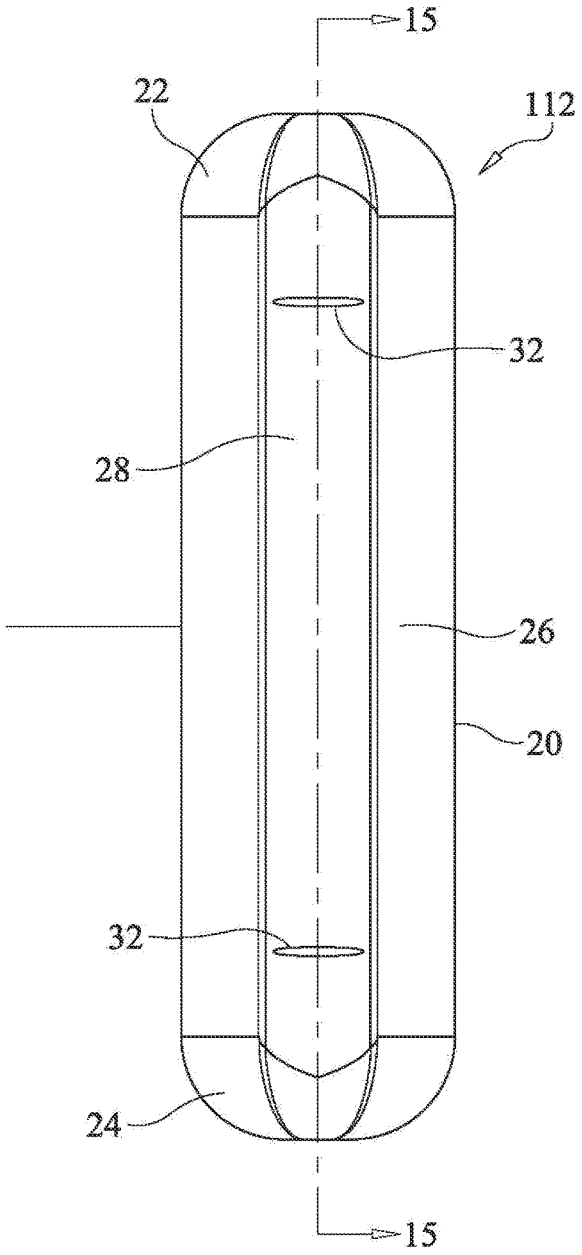
FIG. 13 is a first side view of a buoyant device showing the outer surface, the first end, the second end, the elongated portion, the concaved area and the pair of projections within the concaved area in accordance with a second embodiment.
Figure 14:
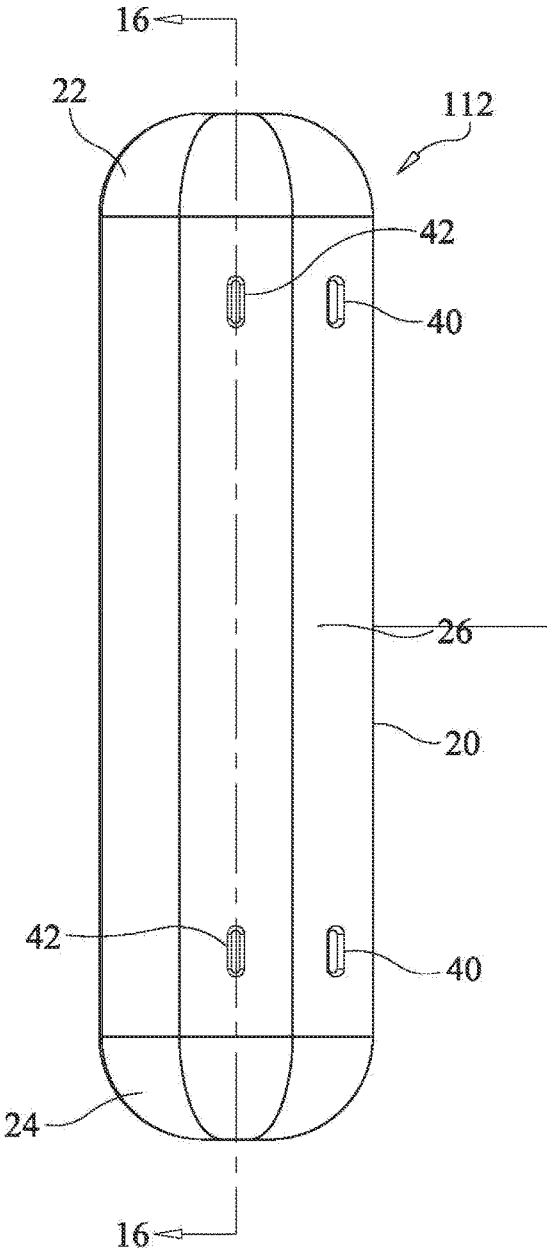
FIG. 14 is a second side view of the buoyant device depicted in FIG. 13 showing the outer surface, the first end, the second end, and first and second strap receiving tunnels in accordance with the second embodiment.
Figure 15:
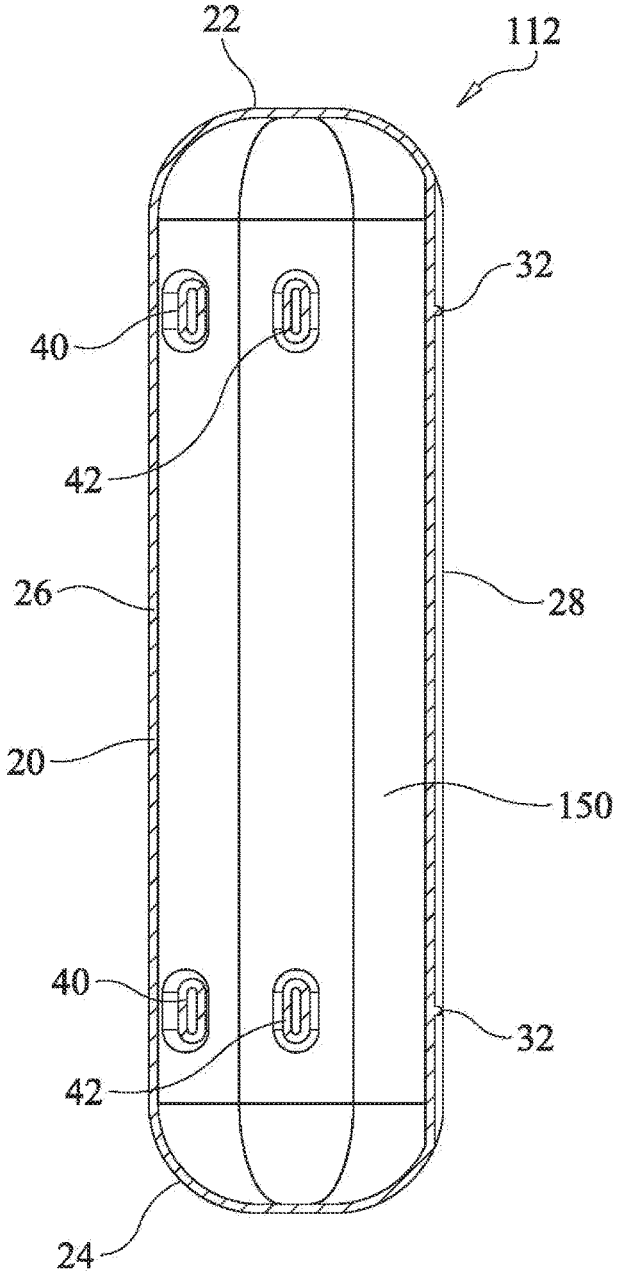
FIG. 15 is a cross-sectional view of the buoyant device taken along the line 15-15 in FIG. 13 showing a hollow interior of the buoyant device, the first and second strap receiving tunnels, the concaved area and the pair of projections within the concaved area in accordance with the second embodiment.
Figure 16:
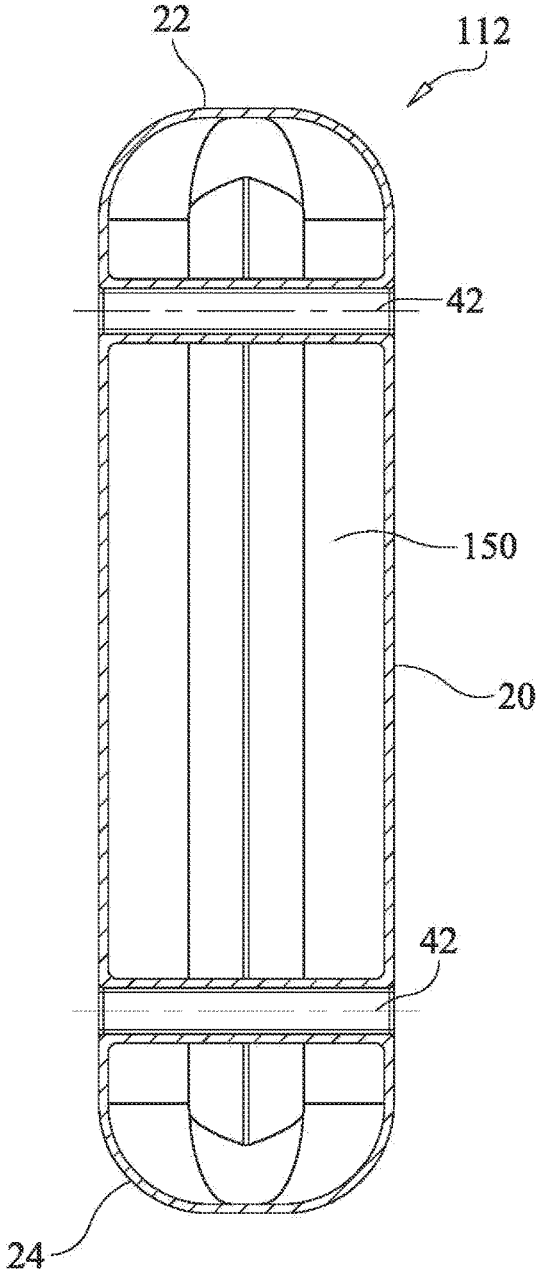
FIG. 16 is a cross-sectional view of the buoyant device taken along the line 16-16 in FIG. 14 showing the hollow interior of the buoyant device and the second strap receiving tunnels that extend through the buoyant device in accordance with the second embodiment.

As shown in FIGS. 10-12, the buoyant device 12 is not hollow in the first embodiment. Rather, the buoyant device 12 is filled with a foam material, such as, for example, expandable polyurethane, polystyrene or other light weight material that ensures buoyancy of the buoyant device 12. The outer surface 20 of the buoyant device 12 is defined an outer wall of the buoyant device 12. The outer wall can be formed from metallic materials or by any of a variety of plastic or polymers materials suitable for use in marine environments.

As shown in FIGS. 4-5, 7-8 and 10-12, the buoyant device 12 includes a pair of first strap receiving tunnels 40 and a pair of second strap receiving tunnels 42. The first strap receiving tunnels 40 extend between flat sections 30 located proximate an opposite side of the buoyant device 12 from the concaved section 28. The first strap receiving tunnels 40 are parallel to one another and parallel to the projections.

The pair of second strap receiving tunnels 42 extend through the buoyant device 12 and are centered with respect thereto, as shown in cross-section in FIGS. 8 and 10. The second strap receiving tunnels 42 are parallel to the first strap receiving tunnels 40 and spaced apart therefrom.

As shown in FIGS. 3 and 4, the straps 16 and 18 are installed to the buoyant devices 12 such that the strap 16 extends through one of the first strap receiving tunnels 40 in each of the plurality of buoyant devices 12 and the strap 18 extends through the other of the first strap receiving tunnels 40 in each of the plurality of buoyant devices 12. The plurality of buoyant devices 12 are tightened to the pipe P such that the straps 16 and 18 press the projections 32 onto the outer surface of the pipe P. The straps 16 and 18 are then tightened. Once the straps 16 and 18 are tightened, contact between the projections 32 and the pipe P ensure that the plurality of buoyant devices 12 to not move in the lengthwise direction $D_1$ relative to the pipe P. Further, since the pipe P extends into each of the concaved sections 28 of the buoyant devices 12, the straps 16 and 18 prevent rotation of the buoyant devices 12 relative to each other. As well, the straps 16 and 18 extending through the first strap receiving tunnels 40 further wrap around all of the buoyant devices 12 holding them together and in place about the pipe P.

The second strap receiving tunnels 42 can be used in applications where fewer numbers of buoyant devices 12 are used, as is shown in the embodiments depicted in FIGS. 25-28 and described in greater detail below.

Second Embodiment

Referring now to FIGS. 13-16, a buoyant device 112 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment be omitted for the sake of brevity.

The buoyant device 112 is basically the same (from the outside) as the buoyant device 12 of the first embodiment, except that the buoyant device 112 has a hollow interior 150. More specifically, the buoyant device 112 includes the outer surface 20 with the first end 22, the second end 24, the elongated portion 26, the concaved section 28 and the projections 32. The buoyant device 112 further includes the first strap receiving tunnels 40 and the second strap receiving tunnels 42, as described above with respect to the first embodiment. In the first embodiment, the buoyant device 12 is not hollow. In the second embodiment, the buoyant device 112 is hollow.

Third Embodiment

Figure 17:
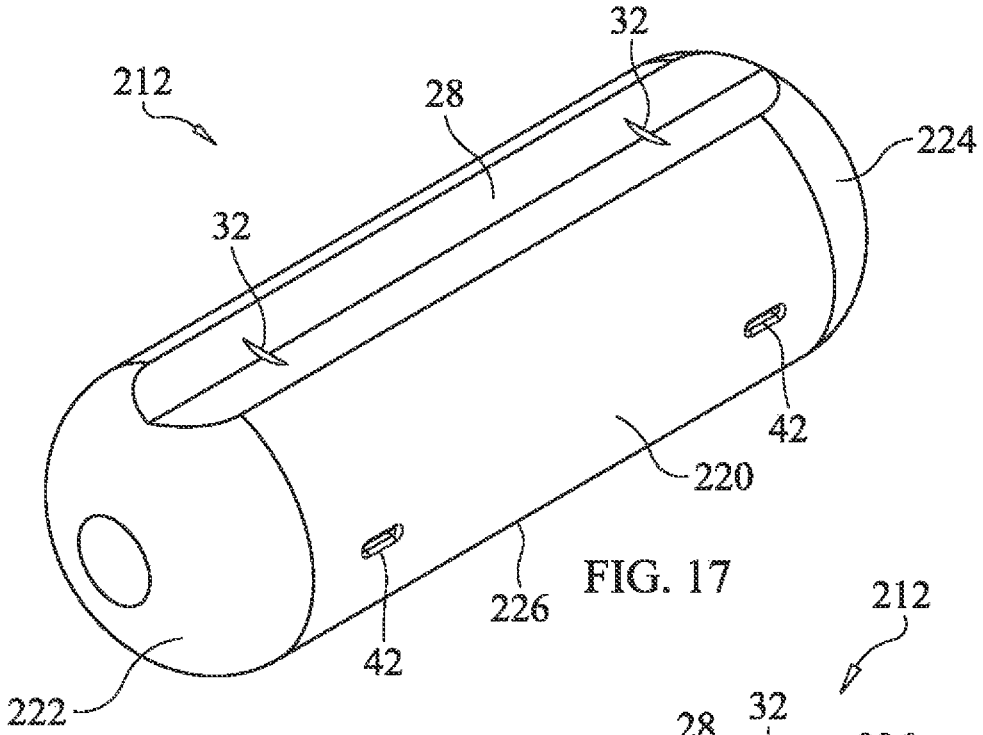
FIG. 17 is a perspective view of a buoyant device having an overall smooth surface in accordance with a third embodiment.
Figure 18:
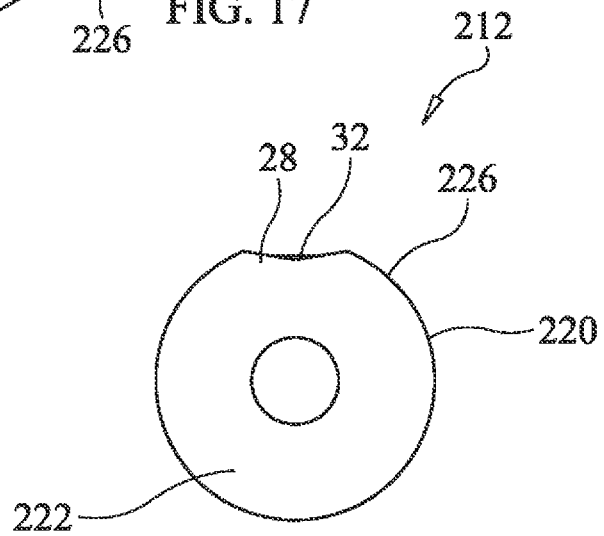
FIG. 18 is an end view of the buoyant device having the overall smooth surface in accordance with the third embodiment.
Figure 19:
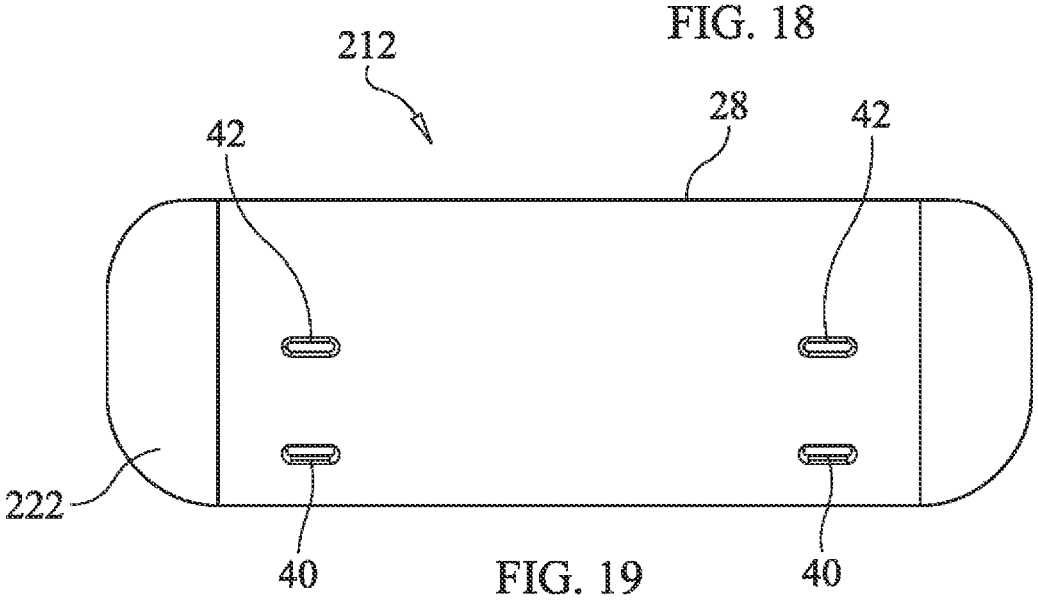
FIG. 19 is a side view of the buoyant device having the overall smooth surface in accordance with the third embodiment.

Referring now to FIGS. 17-19, a buoyant device 212 in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

The buoyant device 212 is very similar to the buoyant device 12 of the first embodiment, except that the buoyant device 212 has a smooth outer surface 220. The buoyant device 212 includes an outer surface 220 with a first end 222, a second end 224 and an elongated portion 226. The outer surface 220 is dimensioned and shaped in a manner similar to the outer surface 20 of the first embodiment, except that the outer surface 220 is smooth and continuous except for the inclusion of the concaved section 28 and the projections 32. The concaved section 28 and the projections 32 are as described in the first embodiment. Similarly, the first end 222 has an overall shape similar to the first end 22 but is smooth. As well, the second end 224 has an overall shape similar to the second end 22 of the first embodiment but is smooth.

The buoyant device 212 further includes the first strap receiving tunnels 40 and the second strap receiving tunnels 42.

Fourth Embodiment

Referring now to FIGS. 20-24, a buoyant device 312 in accordance with fourth embodiment will now be explained. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

The buoyant device 312 of the fourth embodiment has some features common with the first embodiment. However, in the fourth embodiment, the buoyant device 312 has an outer surface 320 that includes a first end 322, a second end 324 and an elongated portion 326. The buoyant device 312 further includes the concaved section 28 and the projections 32 of the first embodiment. The buoyant device 312 further includes at least one the first strap receiving tunnels 40 and at least one of the second strap receiving tunnels 42, as described in the first embodiment.

Figure 20:
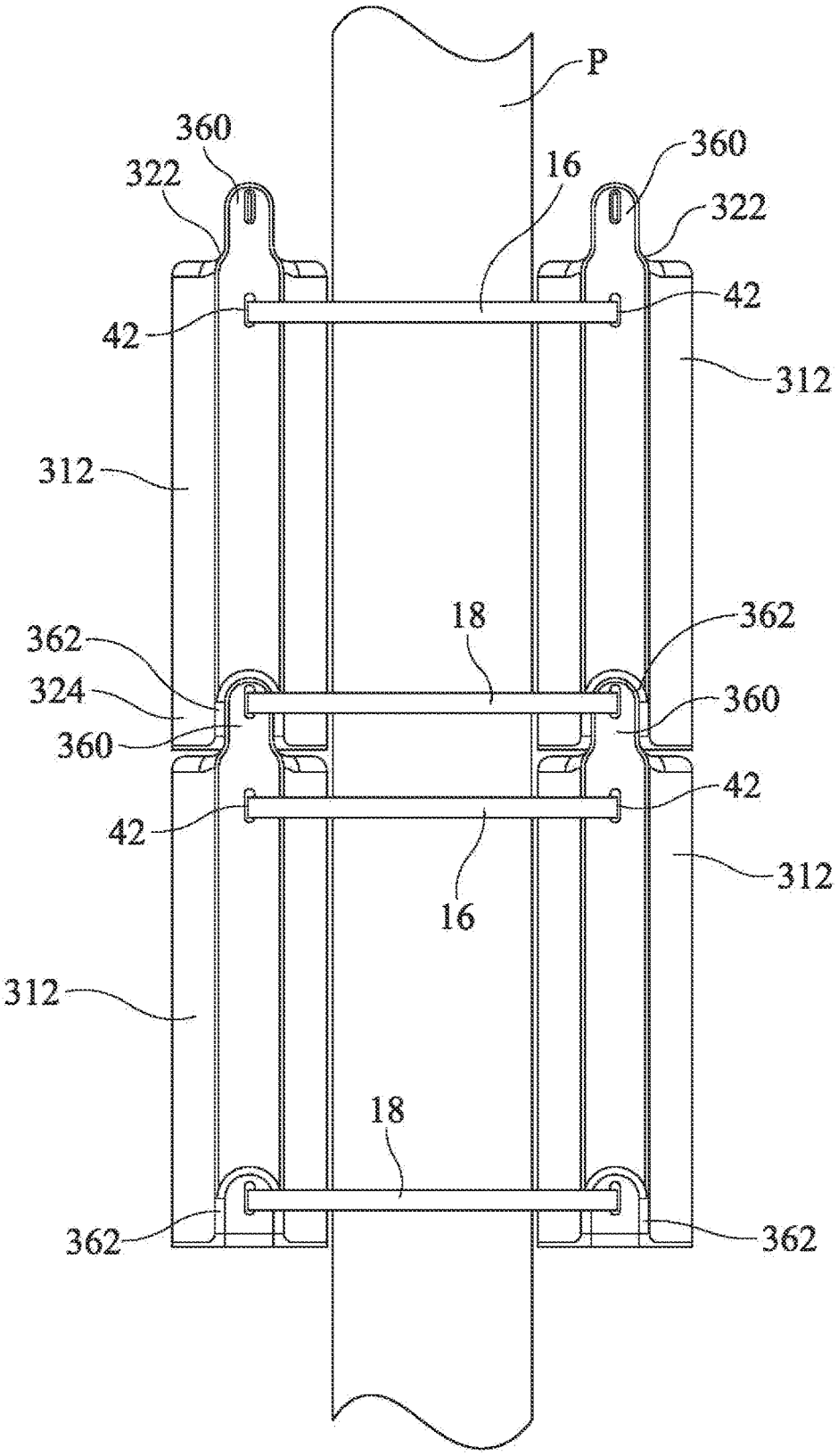
FIG. 20 is a side view of a slurry pipe and a plurality of buoyant devices attached to the slurry pipe in accordance with a fourth embodiment.
Figure 21:
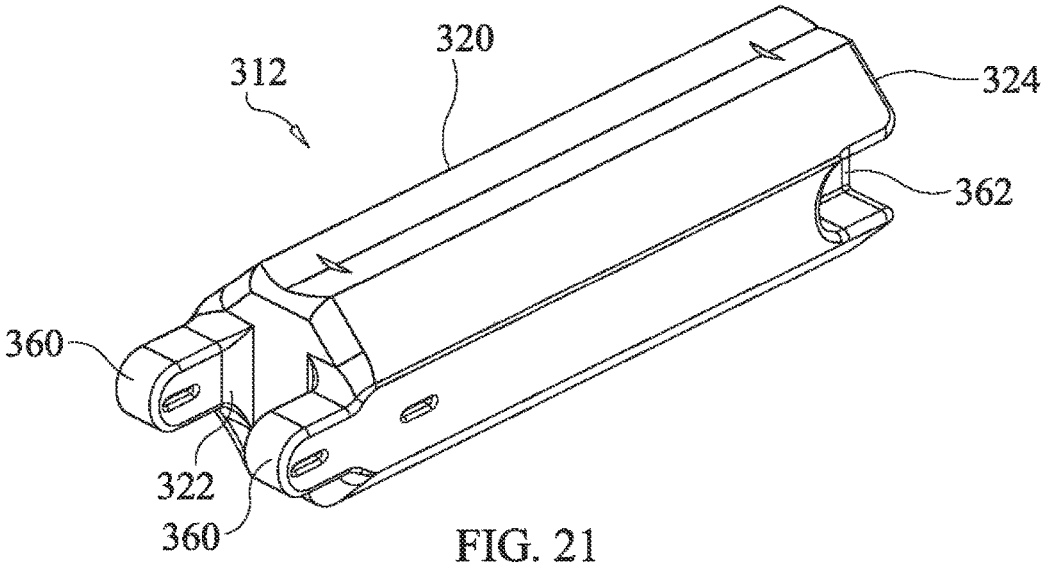
FIG. 21 is a perspective view of one of the buoyant devices depicted in FIG. 20 showing a pair of attachment projections at a first end thereof and a pair of recesses at a second end thereof in accordance with the fourth embodiment.
Figure 22:
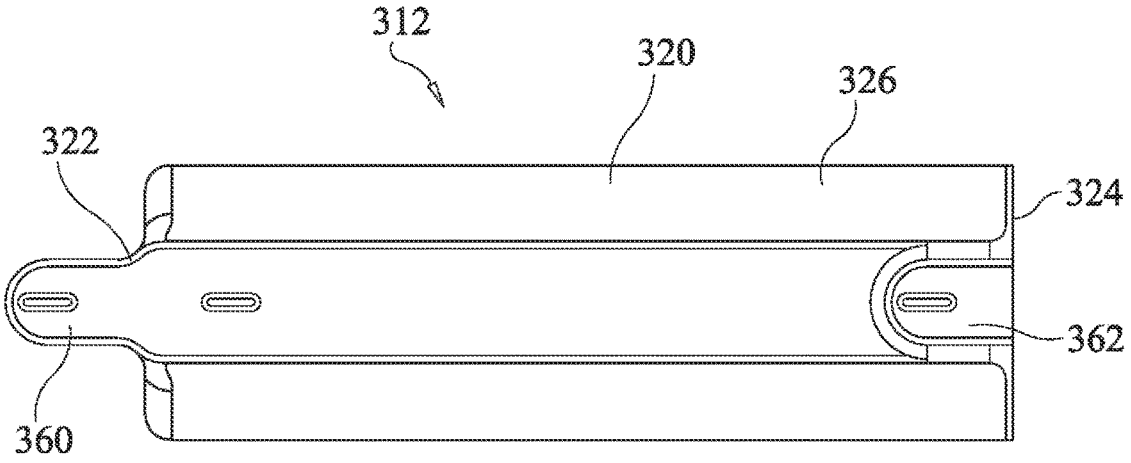
FIG. 22 is a side view of the buoyant device depicted in FIG. 1 showing the pair of attachment projections and the pair of recesses in accordance with the fourth embodiment.
Figure 23:
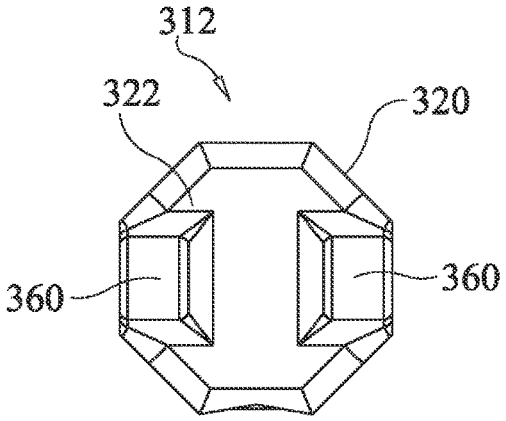
FIG. 23 is a first end view of the buoyant device depicted in FIGS. 21 and 21 showing the projections in accordance with the fourth embodiment.
Figure 24:
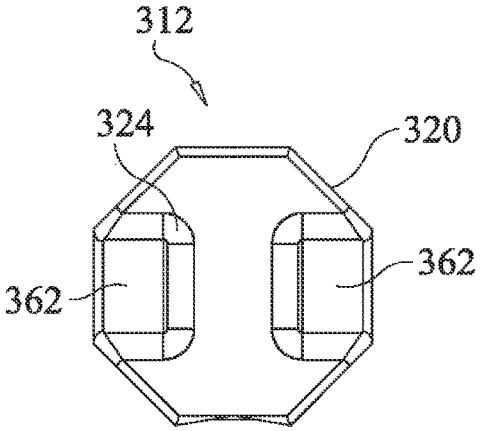
FIG. 24 is a second end view of the buoyant device depicted in FIGS. 20-23 showing the recesses in accordance with the fourth embodiment.

The first end 322 includes a pair of attachment projections 360 that extend from the elongated portion 326. The second end 324 includes a pair of recesses 362 that are shaped and dimensioned to receive the pair of attachment projections 360. As shown in FIG. 20, the second end 324 of the buoyant device 312 can be attached to the first end 322 of a second of the buoyant device 312 via a pair of attachment projections 360 of the second of the buoyant devices 312 being inserted into the pair of recesses 362 at the second end of the first of the buoyant device 312. The strap 16 is inserted the second strap receiving tunnels 42 and the strap 18 is fitted into openings of the projections 360 and thereafter into openings (equivalent to another strap receiving tunnel) in the recesses 362 fixing the two of the buoyant devices 312 together.

Thus a plurality of the buoyant devices 312 can be attached about the outer surface of the pipe P, and at least pairs of buoyant devices 312 can be attached to one another end to end. It should be understood that many buoyant devices 312 can be attached to one another end to end depending on the length of the pipe P and the buoyancy requirements of the slurry transporting riser assembly 10.

Fifth Embodiment

Referring now to FIGS. 25-28, a slurry transporting riser assembly 10 in accordance with a second embodiment will no be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Figure 25:
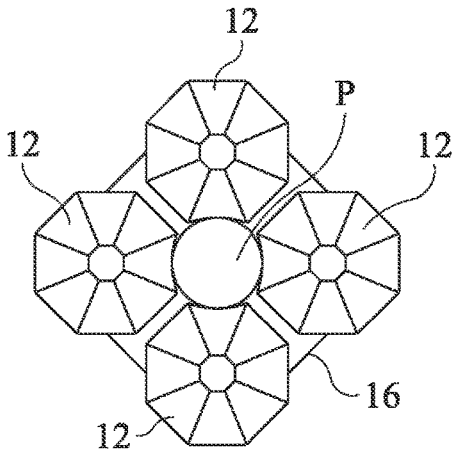
FIG. 25 is an end view of a slurry pipe with four of the buoyant devices strapped thereto in accordance with a fifth embodiment.

Referring now to FIG. 25, a slurry transporting riser assembly in accordance with a fifth embodiment will now be explained. In view of the similarity between the first and fifth embodiments, the parts of the fifth embodiment that are identical to the parts of the first embodiment will be given the same reference numerals as the parts of the first embodiment. Moreover, the descriptions of the parts of the fifth embodiment that are identical to the parts of the first embodiment may be omitted for the sake of brevity.

In the fifth embodiment, a plurality of the buoyant devices 12 are installed about the pipe P. The diameter of the pipe P and the dimensions of the buoyant devices can, in certain circumstances, be used determine how many buoyant devices 12 are needed. In the fifth embodiment, four of the buoyant devices 12 are strapped about the pipe P with straps 16 being installed in the strap receiving tunnels 42, as shown in FIG. 25.

Sixth Embodiment

Figure 26:
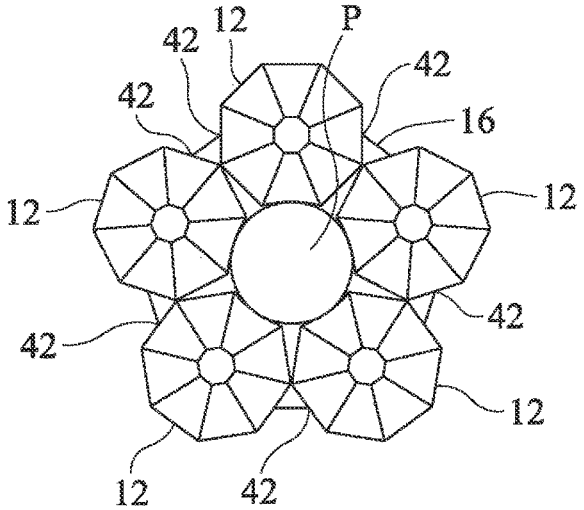
FIG. 26 is an end view of a slurry pipe with five of the buoyant devices strapped thereto in accordance with a sixth embodiment.

Referring now to FIGS. 26, a slurry transporting riser assembly in accordance with a sixth embodiment will now be explained. In view of the similarity between the first and sixth embodiments, the parts of the sixth embodiment that are identical to the parts of the first embodiment will be given the same reference numerals as the parts of the first embodiment. Moreover, the descriptions of the parts of the sixth embodiment that are identical to the parts of the first embodiment may be omitted for the sake of brevity.

In the sixth embodiment, a plurality of the buoyant devices 12 are installed about the pipe P. In the sixth embodiment, five of the buoyant devices 12 are strapped about the pipe P with straps 16 being installed in the strap receiving tunnels 42, as shown in FIG. 26.

Seventh Embodiment

Figure 27:
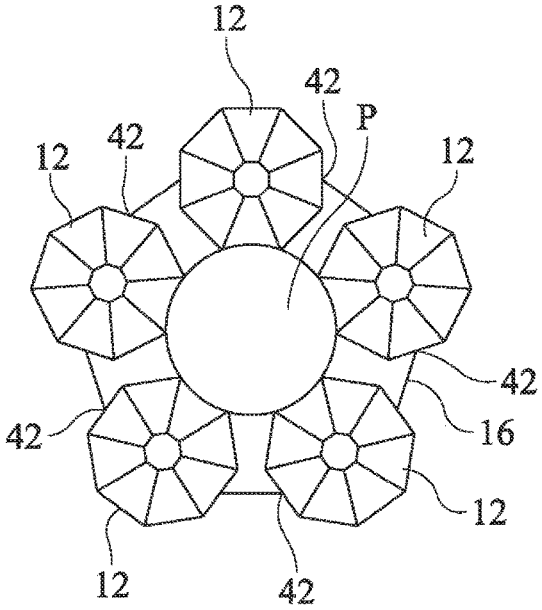
FIG. 27 is an end view of a slurry pipe with five of the buoyant devices strapped thereto in accordance with a seventh embodiment.

Referring now to FIG. 27, a slurry transporting riser assembly in accordance with a seventh embodiment will now be explained. In view of the similarity between the first and seventh embodiments, the parts of the seventh embodiment that are identical to the parts of the first embodiment will be given the same reference numerals as the parts of the first embodiment. Moreover, the descriptions of the parts of the seventh embodiment that are identical to the parts of the first embodiment may be omitted for the sake of brevity.

In the seventh embodiment, the relative diameter of the pipe P is larger than in the sixth embodiments. A plurality of the buoyant devices 12 are installed about the pipe P. In the seventh embodiment, five of the buoyant devices 12 are again strapped about the pipe P with straps 16 being installed in the strap receiving tunnels 42, as shown in FIG. 26. Alternatively, the straps 16 can be installed in the strap receiving tunnels 40 (not shown in FIG. 27).

Eighth Embodiment

Figure 28:
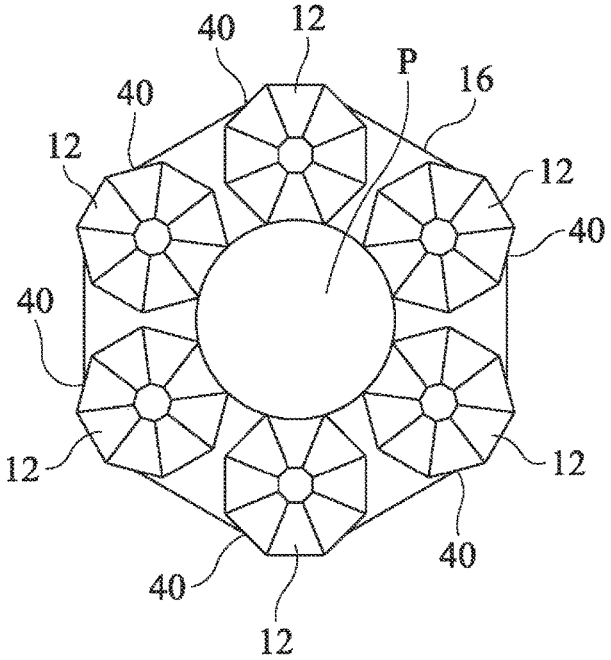
FIG. 28 is an end view of a slurry pipe with six of the buoyant devices strapped thereto in accordance with an eighth embodiment.

Referring now to FIG. 28, a slurry transporting riser assembly in accordance with an eighth embodiment will now be explained. In view of the similarity between the first and eighth embodiments, the parts of the eighth embodiment that are identical to the parts of the first embodiment will be given the same reference numerals as the parts of the first embodiment. Moreover, the descriptions of the parts of the eighth embodiment that are identical to the parts of the first embodiment may be omitted for the sake of brevity.

In the eighth embodiment, the relative diameter of the pipe P is larger than in the sixth and seventh embodiments. A plurality of the buoyant devices 12 are installed about the pipe P. In the eighth embodiment, six of the buoyant devices 12 are strapped about the pipe P with straps 16 being installed in the strap receiving tunnels 40, as shown in FIG. 28.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of a vehicle equipped with the slurry transporting riser assembly. Accordingly, these terms, as utilized to describe the present invention should be interpret relative to a vehicle equipped with the slurry transporting riser assembly.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the Various components can be changed as needed and/or desired. Components that are shown directly connected or contacting each other can have intermediate structures disposed between them. The functions of one element can be performed two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A float apparatus, comprising a buoyant device dimensioned and configured to attach to a generally horizontally oriented conduit to keep the conduit proximate the surface of a body of liquid, the buoyant device having an outer surface defining a first end portion, a second end portion and an elongated portion that extends from the first end portion to the second end portion, a first area of the outer surface defining a concaved section that extends from the first end portion to the second end portion, the buoyant device including at least one strap receiving tunnel that extends through the elongated portion of the buoyant device at a location spaced apart from the first end portion and the second end portion; and at least one strap extending through the at least one strap receiving tunnel securing the buoyant device to the conduit with at least a portion of the concaved section directly contacting the conduit, the buoyant device being free of any other fastening structures such that the buoyant device is fixed to the conduit by the at least one strap.

2. The float apparatus according to claim 1, wherein each of the first end portion and the second end portion of the outer surface of the buoyant device has an overall semi-spherical shape.

3. The float apparatus according to claim 1, wherein the buoyant device has an overall length measured in a lengthwise direction of the buoyant device, and the concaved section of the outer surface of buoyant device includes at least one protrusion, the at least one protrusion extends in a direction perpendicular to the lengthwise direction of the buoyant device such that the at least one protrusion contacts the conduit and prevents movement of the buoyant device relative to a lengthwise direction of the conduit with the at least one strap attaching the buoyant device to the conduit.

4. The float apparatus according to claim 3, wherein the concaved section of the outer surface of buoyant device includes two of the at least one protrusions.

5. The float apparatus according to claim 1, wherein the elongated portion of the outer surface of the buoyant device has eight areas that define an overall octagonal shape with one of eight sections of the outer surface being the concaved section.

6. The float apparatus according to claim 1, wherein the elongated portion of the outer surface of the buoyant device has a smooth cylindrical shape interrupted by the concaved section and openings exposing opposite ends of the at least one strap receiving tunnel.

7. The float apparatus according to claim 1, wherein the buoyant device is filled with a foam material.

8. The float apparatus according to claim 7, wherein the outer surface of the buoyant device including the first end portion, the second end portion and the elongated portion is formed by the foam material.

9. The float apparatus according to claim 1, wherein the buoyant device has a hollow interior completely surrounded by the first end portion, the second end portion and the elongated portion of the outer surface.

10. The float apparatus according to claim 1, wherein the at least one strap receiving tunnel of the buoyant device includes a first strap receiving tunnel and a second strap receiving tunnel that is parallel to the first strap receiving tunnel.

11. A float apparatus, comprising a plurality of buoyant devices that are each dimensioned and configured to attach to a generally horizontally oriented conduit in order to keep the conduit proximate the surface of a body of liquid, each of the plurality of buoyant devices having an outer surface defining a first end portion, a second end portion and an elongated portion that extends from the first end portion to the second end portion, each of the plurality of buoyant devices including a first strap receiving tunnel that extends through a portion of the elongated portion, and the elongated portion of each of the plurality of buoyant devices includes a concaved section that extends from the first end portion to the second end portion, the concaved section defining a shape that is configured to receive an outer portion of the conduit, and a strap attaching the plurality of buoyant devices to the conduit by extending through the strap receiving tunnel of each of the plurality of buoyant devices and around the conduit with at least a portion the concaved sections of each of the buoyant devices directly contacting the conduit, with the buoyant device being free of any other fastening or support structures such that the plurality of buoyant devices are fixed to the conduit by the strap and the plurality of buoyant devices are fixed to one another by the strap.

12. The float apparatus according to claim 11, wherein the concaved section of the outer surface of each of the plurality of buoyant device includes at least one protrusion dimensioned and shaped to contact the conduit preventing movement therebetween with the plurality of buoyant devices attached to the conduit by the strap.

13. The float apparatus according to claim 12, wherein each of the plurality of buoyant devices has an overall length measured in a lengthwise direction of the buoyant device, and the at least one protrusion extends in a direction perpendicular to the lengthwise direction of the buoyant device.

14. The float apparatus according to claim 11, wherein each of the plurality of buoyant devices includes an additional strap receiving tunnel that extends parallel to the strap receiving tunnel.

15. The float apparatus according to claim 11, wherein each of the first end portion and the second end portion of the outer surface of the buoyant device has an overall semi-spherical shape.

16. The float apparatus according to claim 11, wherein each of the plurality of buoyant devices is filled with a foam material.

17. The float apparatus according to claim 16, wherein the outer surface of each of the plurality buoyant device including the first end portion, the second end portion and the elongated portion is formed by the foam material.

18. The float apparatus according to claim 11, wherein the outer surface including the first end portion, the second end portion and the elongated portion of each of the plurality of buoyant devices is formed by a foam material.

19. The float apparatus according to claim 18, wherein each of the plurality of buoyant devices has a hollow interior completely surrounded by the outer surface.

* * * * *